US006758688B2

(12) United States Patent
Chen

(10) Patent No.: US 6,758,688 B2
(45) Date of Patent: Jul. 6, 2004

(54) CONNECTOR SECURING DEVICE

(75) Inventor: Yun-Lung Chen, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/299,116

(22) Filed: Nov. 18, 2002

(65) Prior Publication Data

US 2003/0220004 A1 Nov. 27, 2003

(30) Foreign Application Priority Data

May 24, 2002 (TW) ..... 91207529 U

(51) Int. Cl.[7] ..... H01R 13/44
(52) U.S. Cl. ..... 439/135; 439/140; 439/147
(58) Field of Search ..... 439/135–147

(56) References Cited

U.S. PATENT DOCUMENTS 4,083,618 A * 4/1978 Busch, Jr. ..... 439/147
4,556,270 A * 12/1985 Schutzle et al. ..... 439/359
5,288,241 A * 2/1994 Davidge et al. ..... 439/304
5,480,312 A * 1/1996 Watanabe et al. ..... 439/135
5,999,411 A * 12/1999 Patel ..... 361/759
6,075,341 A * 6/2000 White et al. ..... 320/114
6,612,853 B2 * 9/2003 Wu ..... 439/136

* cited by examiner

*Primary Examiner*—Michael C. Zarroli
(74) *Attorney, Agent, or Firm*—Wei Te Chung

(57) ABSTRACT

A connector securing device (10) includes a top wall (12), a bottom wall (14), a pair of side walls (16, 26), and an end wall (18) cooperatively defining a cavity (20) therebetween for receiving a connector (50) therein. A pair of resilient tabs (30) is formed in front portions of the top and bottom walls respectively, and each resilient tab forms an outer latching portion (34) at a free end thereof. The end wall defines a through hole (40) for extension of a cable (52) of the connector therethrough. After the connector is received in the connector securing device, the combined connector and connector securing device is plugged into aligned openings (64, 68) defined in an I/O interface (60). The latching portions engage in one of the openings of the I/O interface, thereby protecting the connector from accidental detachment from a complementary mating connector at the I/O interface.

15 Claims, 3 Drawing Sheets

CONNECTOR SECURING DEVICE

BACKGROUND OF THE INVENTION

1. Field of the Invention

The present invention relates to a securing device, and particularly to a connector securing device which can protect a connector from accidental detachment from a complementary mating connector.

2. Description of Related Art

Conventionally, a first connector for transmitting communication signals is directly plugged into a complementary mating connector without any securing or protection device to protect the first connector from accidental detachment from the mating connector. When a cable of the first connector is inadvertently pulled or dragged, the first connector can be easily detached from the mating connector thereby causing interruption of signals.

To solve the above problem, various forms of latching or retention devices are adopted to secure a first connector to its complementary mating connector. Contemporary retention devices vary widely. They range from integral latches on the first connector itself to separate threaded or screw members that secure the first connector to the mating connector and/or a panel. Taiwan Patent Application No. 87212569 discloses a conventional connector securing device. The connector comprises two sleeves. A pair of jackscrews are rotatably mounted in the sleeves respectively. A complementary mating connector comprises two jackscrew nuts corresponding to the jack screws. Threaded distal ends of the jackscrews are threadedly received in the corresponding jackscrew nuts. Thus the first connector is fixedly secured to the mating connector.

However, this connector securing device adds extra components and structures to the connectors. Manufacturing of the connectors is more complicated. All these factors increase the cost of the connectors.

Therefore, a connector securing device which overcomes the above-mentioned problems is strongly desired.

SUMMARY OF THE INVENTION

Accordingly, an object of the present invention is to provide a low-cost connector securing device having a simple structure which can effectively protect a connector from accidental detachment from its mating connector.

In order to achieve the above object, a connector securing device or connector protector in accordance with a preferred embodiment of the present invention comprises a top wall, a bottom wall, a pair of side walls, and an end wall. The walls cooperatively define a cavity therebetween for receiving a connector therein. A pair of resilient tabs is formed in front portions of the top and bottom walls respectively, and each resilient tab forms an outer latching portion at a free end thereof. The end wall defines a through hole, for extension of a cable of the connector therethrough. An entrance is defined in one of the side walls. After the connector is received in the connector securing device, the combined connector and connector securing device is plugged into aligned openings defining in an input/output (I/O) interface. The latching portions of the resilient tabs engage in one of the openings of the I/O interface, thereby protecting the connector from accidental detachment from a complementary mating connector at the I/O interface.

Other objects, advantages and novel features of the present invention will become more apparent from the following detailed description when taken in conjunction with the accompanying drawings, in which:

DETAILED DESCRIPTION OF THE INVENTION

Figure 1:
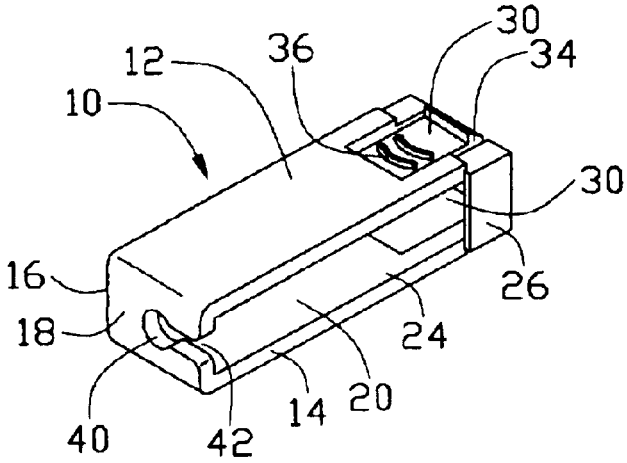
FIG. 1 is an isometric view of a connector securing device in accordance with a preferred embodiment of the present invention.
Figure 2:
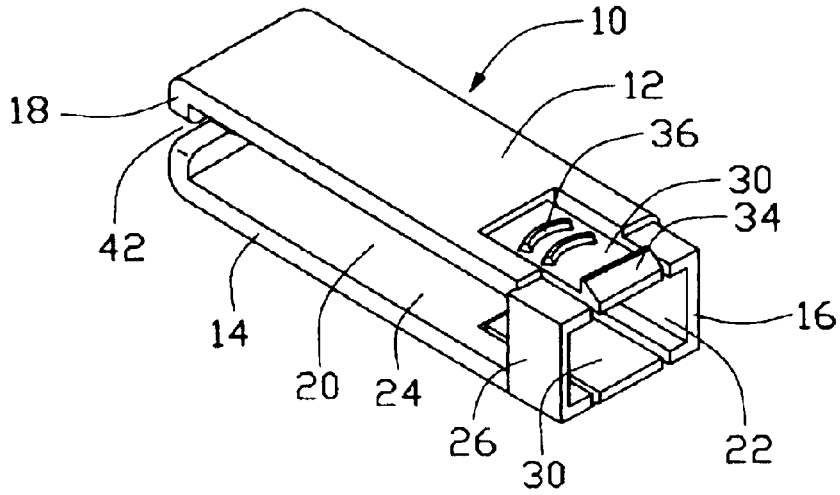
FIG. 2 is an isometric view of the connector securing device of FIG. 1, viewed from another aspect.
Figure 3:
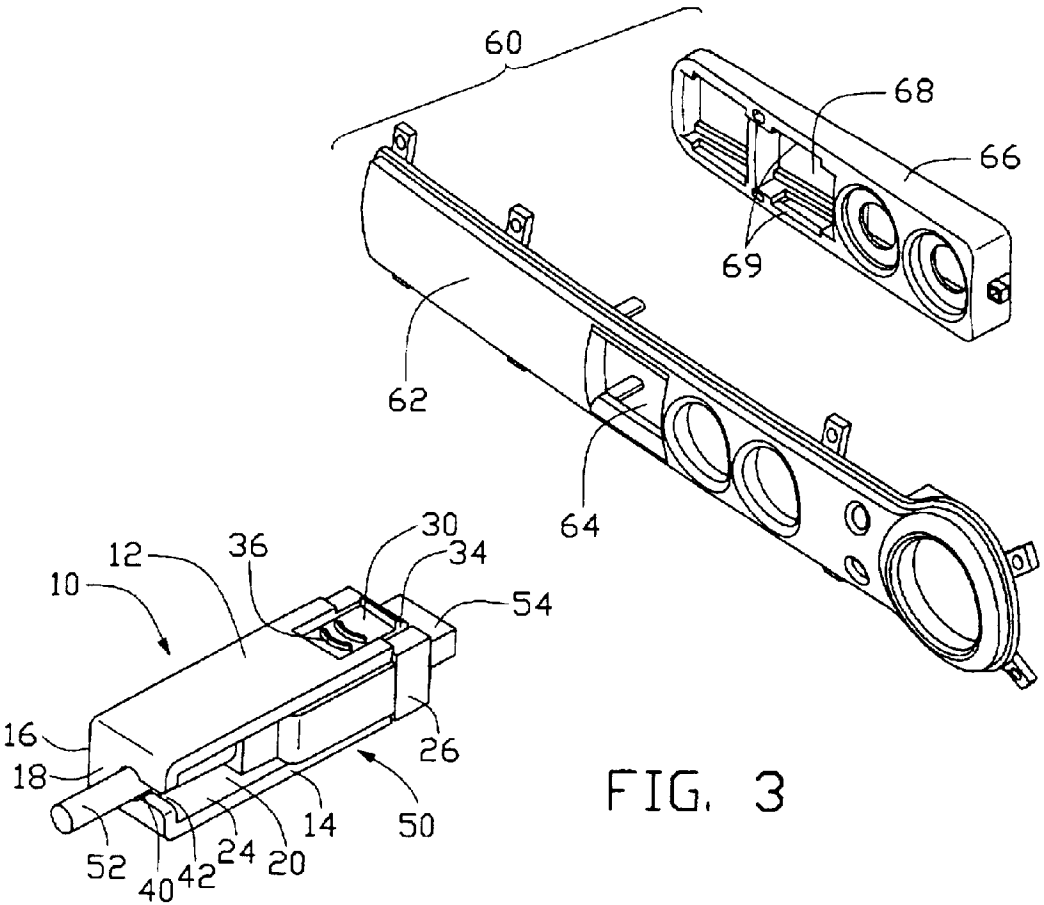
FIG. 3 is an exploded isometric view of the connector securing device in accordance with the preferred embodiment of the present invention with a connector received therein, showing the combined connector securing device and connector ready for attachment to an I/O interface.

Referring to FIGS. 1–3, a connector securing device 10 in accordance with a preferred embodiment of the present invention receives a connector 50 therein, and is fixed to an I/O interface 60.

The connector securing device 10 comprises a top wall 12, a bottom wall 14 parallel to the top wall 12, a pair of side walls 16, 26 connecting the top wall and bottom walls 12, 14, and an end wall 18. A third opening 22 is defined in an end of the connector securing device 10 that is opposite from the end wall 18. The walls 12, 14, 16, 26 cooperatively define a cavity 20 therebetween for receiving the connector 50 therein. The cavity 20 is in communication with the third opening 22. A pair of resilient tabs 30 is formed in front portions of the top and bottom walls 12, 14 respectively, at opposite sides of the third opening 22 respectively. Each resilient tab 30 forms an outer latching portion 34 at a free end thereof. A plurality of arcuate, low-profile protrusions 36 is formed on an outside surface of each resilient tab 30, for facilitating operation thereof. The end wall 18 defines a through hole 40, for extension of a cable 52 of the connector 50 therethrough. An entrance 24 is defined in the side wall 26. A gap 42 is defined in the end wall 18, spanning from the entrance 24 of the side wall 26 to the through hole 40 of the end wall 18.

The I/O interface 60 comprises a first plate 62, and a second plate 66 attached to the first plate 62. The first plate 62 defines a first opening 64, and the second plate 66 defines a second opening 68 aligning with the first opening 64. A pair of fastening sections 69 is respectively formed in top and bottom portions of the second plate 66 at the second opening 68.

The connector 50 also has a plug 54 at an end thereof.

Figure 4:
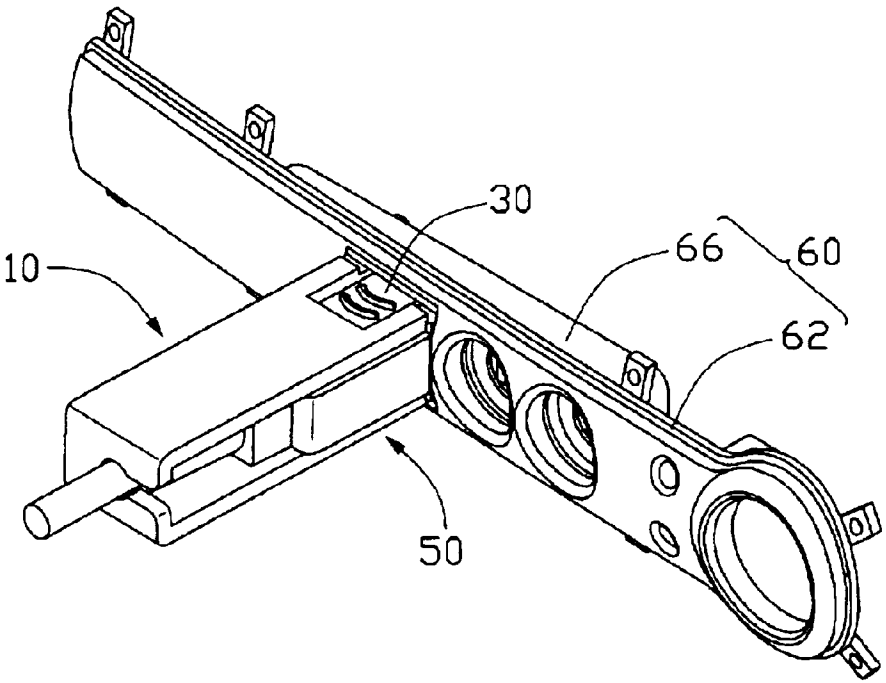
FIG. 4 is an assembled view of FIG. 3.

Referring also to FIG. 4, in use, the connector 50 is passed through the entrance 24 of the side wall 26 and placed in the cavity 20 of the connector securing device 10. The side wall 26 locates the plug 54 of the connector 50 in a correct position, and the plug 54 protrudes through the third opening 22 to an exterior of the connector securing device 10. The cable 52 of the connector 50 is passed through the gap 42 into the through hole 40. Thus the connector 50 is firmly secured in the connector securing device 10. Then the resilient tabs 30 are squeezed toward each other, and the combined connector 50 and connector securing device 10 is plugged into the first and second openings 64, 68 of the first and second plates 62, 66. The resilient tabs are then released, and the latching portions 34 of the resilient tabs 30 engage with the fastening sections 69 of the second plate 66 at the second opening 68. The combined connector 50 and connector securing device 10 is thus firmly secured to the I/O interface 60. Because the connector 50 is firmly secured in the connector securing device 10, the connector 50 is protected from accidental detachment from a complementary mating connector at the I/O interface.

It is understood that the invention may be embodied in other forms without departing from the spirit thereof. Thus, the present examples and embodiment are to be considered in all respects as illustrative and not restrictive, and the invention is not to be limited to the details given herein.

What is claimed is:

1. A connector securing device for securing a connector at an input/output interface, the connector securing device comprising:

a top wall;

a bottom wall parallel to the top wall;

a side wall connecting the top and bottom walls;

an end wall cooperating with the top, bottom and the side walls to define a cavity (20) therebetween;

an entrance (24) defined in one of the walls and communicating with the cavity (20) in a first direction perpendicular to said side wall, for insertion of the connector into the cavity;

at least one resilient tab provided in at least one of the walls for engaging with the input/output interface; and an opening (22) defined in an opposite end relative to the end wall (18) in communication with the cavity (20) in a second direction which is essentially along a longitudinal direction of the cavity (20) and generally perpendicular to the first direction, for extension of a part of the connector; wherein the opening (22) is dimensioned and configured to only allow the connector, which is received in the cavity (20), to extend along said longitudinal direction.

2. The connector securing device as described in claim 1, wherein the end wall defines a hole, and a gap spanning from the entrance to the hole.

3. The connector securing device as described in claim 1, wherein the connector securing device comprises two resilient tabs provided at front portions of the top and bottom walls respectively.

4. The connector securing device as described in claim 1, wherein the at least one resilient tab comprises an outer latching portion at a free end thereof.

5. The connector securing device as described in claim 1, wherein a plurality of protrusions is formed on the at least one resilient tab, for facilitating operation thereof.

6. A connector securing device assembly, comprising:

a connector;

a housing comprising a top wall, a bottom wall, a side wall, and an end wall cooperatively defining a cavity therebetween, an entrance being defined in one of the walls for insertion of the connector into the cavity;

an input/output interface comprising a first plate and a second plate attached to the first plate; and at least one resilient tab provided in at least one of the walls of the housing and engaging with the input/output interface;

wherein the at least one resilient tab comprises an outer latching portion at a free end thereof, the first plate defines a first opening, and the second plate defines a second opening aligning with the first opening.

7. The connector securing device as described in claim 6, wherein an opening is defined in an end of the housing opposite from the end wall and in communication with the cavity, and the connector protrudes through the opening.

8. The connector securing device as described in claim 6, wherein the end wall defines a hole, and a gap spanning from the entrance to the hole.

9. The connector securing device as described in claim 6, wherein the connector securing device comprises two resilient tabs provided at front portions of the top and bottom walls, a pair of fastening sections is provided in top and bottom portions of the second plate at the second opening, and the latching portions of the resilient tabs engage with the fastening sections.

10. The connector securing device as described in claim 6, wherein a plurality of protrusions is formed on the at least one resilient tab, for facilitating operation thereof.

11. An electrical connector assembly comprising:

an interface device defining a mating opening extending therethrough in a first direction;

a connector protector defining a cavity with a front opening and a side opening communicating therewith;

an electrical connector with a main body retainably disposed in said cavity with a mating portion extending out of the front opening and into the mating opening; wherein and a locking section is formed on the protector to latchably engage a portion of said interface device around said mating opening; wherein said side opening is dimension to allow the main body of the connector to pass during assembling.

12. The assembly as described in claim 11, wherein said connector includes a cable rearwardly extending from a rear portion of the main body of the connector, and further out of a rear face of the protector.

13. The assembly as described in claim 11, wherein said locking section includes at least one resilient arm, with a hook at a free end, deflectable in a second direction perpendicular to said first direction.

14. The assembly as described in claim 11, wherein the rear opening and the side opening communicate with each other via a slot formed in the rear face, said slot extending along a lateral direction perpendicular to said first direction.

15. The assembly as described in claim 14, wherein said locking section includes at least one resilient arm, with a hook at a free end, deflectable in a second direction perpendicular to both said first direction and said lateral direction.

* * * * *